US008608873B2

(12) United States Patent
Abratis et al.

(10) Patent No.: US 8,608,873 B2
(45) Date of Patent: Dec. 17, 2013

(54) STAINLESS STEEL, COLD STRIP PRODUCED FROM THIS STEEL, AND METHOD FOR PRODUCING A FLAT STEEL PRODUCT FROM THIS STEEL

(75) Inventors: Cornel Abratis, Hamburg (DE); Lutz Ernenputsch, Krefeld (DE); Wilfried Klos, Grevenbroich (DE); Hans-Joachim Krautschick, Solingen (DE); Michael Sachtleber, Korschenbroich (DE)

(73) Assignee: Outokumpu Nirosta GmbH, Krefeld (DE)

( * ) Notice: Subject to any disclaimer, the term of this patent is extended or adjusted under 35 U.S.C. 154(b) by 0 days.

(21) Appl. No.: 13/061,842

(22) PCT Filed: Sep. 3, 2009

(86) PCT No.: PCT/EP2009/061405
§ 371 (c)(1),
(2), (4) Date: Jul. 26, 2011

(87) PCT Pub. No.: WO2010/029012
PCT Pub. Date: Mar. 18, 2010

(65) Prior Publication Data

US 2011/0293464 A1 Dec. 1, 2011

(30) Foreign Application Priority Data

Sep. 11, 2008 (EP) ..... 08105309

(51) Int. Cl.

| | |
|---|---|
| ***C22C 38/38*** | (2006.01) |
| ***C22C 38/42*** | (2006.01) |
| ***C21D 7/02*** | (2006.01) |
| ***B22D 11/04*** | (2006.01) |

(52) U.S. Cl.
USPC ..... 148/327; 148/325; 148/541; 148/542; 148/610; 420/58; 420/60; 420/61; 164/463

(58) Field of Classification Search
USPC ..... 148/325, 327, 329, 610, 541, 542; 420/58, 60, 73, 74, 76, 61; 164/463
See application file for complete search history.

(56) References Cited

U.S. PATENT DOCUMENTS

| | | | |
|---|---|---|---|
| 3,940,266 | A | 2/1976 | Goller et al. |
| 6,274,084 | B1 | 8/2001 | Haudrechy |
| 7,938,917 | B2 | 5/2011 | Okamoto et al. |
| 2004/0025979 | A1 | 2/2004 | Bruckner et al. |

FOREIGN PATENT DOCUMENTS

| | | | |
|---|---|---|---|
| CN | 101098973 | A | 1/2008 |
| EP | 0 593 158 | A1 | 4/1994 |
| EP | 0 694 626 | A1 | 1/1996 |
| EP | 0 969 113 | A1 | 1/2000 |
| EP | 1 352 982 | A2 | 10/2003 |
| EP | 1 431 408 | A1 | 6/2004 |
| EP | 1 319 091 | B1 | 1/2007 |
| ES | 2 142 756 | A1 | 4/2000 |
| JP | 56-146862 | A | 11/1981 |
| JP | 61-124556 | A | 6/1986 |

OTHER PUBLICATIONS

Machine-English translation of Japanese patent 2007-063632, Oshima Takayuki et al., Mar. 15, 2007.*

ASM International, Materials Park, Ohio, Introduction to Steels and Cast Irons, "Table 1.1 Essential and Incidental Elements in Steel and Cast Iron", 1999.*

Oshima et al.; "Effects of Alloying Elements on Solidification Structures in Cr-Mn-Ni Austenitic Stainless Steels"; Journal of the Iron and Steel Institute of Japan; Jan. 1, 2006; pp. 16-22; vol. 92, No. 6; Iron and Steel Institute of Japan; Tokyo, JP.

Sanchez et al.; "Properties of an Austenitic Stainless with Less Than 2% Nickel"; European Stainless Steel Conference; Oct. 11, 2003; pp. 2.231-2.236; vol. 124, No. 12; Italy.

* cited by examiner

*Primary Examiner* — Deborah Yee
(74) *Attorney, Agent, or Firm* — The Webb Law Firm

(57) ABSTRACT

A stainless steel and a flat cold product produced therefrom, which can be easily produced in an economical manner. A steel according to the invention, in the cold-rolled state, has a microstructure with 5-15% by volume δ-ferrite and austenite as the remainder. It contains (in % by weight):
C: 0.05-0.14%, Si: 0.1-1.0%, Mn: 4.0-12.0%, Cr: >17.5-22.0%, Ni: 1.0-4.0%, Cu: 1.0-3.0%, N: 0.03-0.2%, P: max. 0.07%, S: max. 0.01%, Mo: max. 0.5%, optionally one or more elements from the group consisting of Ti, Nb, B, V, Al, Ca, As, Sn, Sb, Pb, Bi, and H wherein Ti: max. 0.02%, Nb: max. 0.1%, B: max. 0.004%, V: max. 0.1%, Al: 0.001-0.03%, Ca: 0.0005-0.003%, As: 0.003-0.015%, Sn: 0.003-0.01%, Pb: max. 0.01%, Bi: max. 0.01%, H: max. 0.0025%, and remainder Fe and unavoidable impurities.

19 Claims, No Drawings

STAINLESS STEEL, COLD STRIP PRODUCED FROM THIS STEEL, AND METHOD FOR PRODUCING A FLAT STEEL PRODUCT FROM THIS STEEL

BACKGROUND OF THE INVENTION

1. Field of the Invention

The invention relates to a stainless steel, a cold-rolled flat steel product produced from this steel, such as a steel strip or a steel sheet, and a method for producing a flat steel product from the steel in question.

2. Description of Related Art

A stainless steel which has in many cases proven successful in practice is known under the designation X5CrNi18-10 and is carried under the EN material number 1.4301. This material is a relatively soft, non-ferromagnetic austenite steel, from which, for example, pots, cutlery, wash basins, parts of domestic appliances, so-called "white goods", such as washing machines, laundry dryers, dishwashers etc. are manufactured. According to DIN EN 10088, in addition to iron and unavoidable impurities, it typically contains (in % by weight) up to 0.07% C, 17.0-19.5% Cr, 8.0-10.5% Ni, max. 1.0% Si, max. 2.0% Mn, max. 0.045% P, max. 0.015% S and max. 0.110% N. The high nickel content here ensures the austenitic structure of the steel, which is a prerequisite for its good formability. The high Cr content here ensures good corrosion resistance of this steel.

The drawback with this steel 1.4301 is, however, that it can only be produced at comparatively high costs, as high prices have to be paid for its alloy constituents, in particular the high nickel content.

Due to the high alloying costs of the steel 1.4301, there are numerous attempts to provide a replacement for this material. The common aim of these attempts is to reduce the nickel content.

An example of a development of this type is described in EP 0 969 113 A1. The austenitic steel known from this publication, apart from iron and unavoidable impurities has (in % by weight) 0.01-0.08% C, 0.1-1% Si, 5-11% Mn, 15-17.5% Cr, 1-4% Ni, 1-4% Cu, 0.1-0.3% N, as well as relatively closely defined contents of sulphur, calcium, aluminium, phosphorus, boron and oxygen.

Another example of a steel of the type being dealt with here is known from JP 56 146862. This austenitic steel contains (in % by weight) up to 0.03% C, up to 0.5% Si, 2.2-3.0% Mn, 14-18% Cr, 6-9% Ni, up to 0.03% N, 0.15-0.50% Mo, 1-3% Cu and iron and unavoidable impurities as the remainder. In this case, particular emphasis is placed on good forming behaviour, which is adjusted by the controlled adjustment of the so-called MD30 value, which is calculated according to a special formula disclosed in JP 56 146862.

"$M_{d30}$" in general designates the temperature at which after a cold forming of 30%, the conversion of austenite into martensite is 50% complete. Above this temperature, on the other hand, a reduced conversion occurs (see Werkstoffkunde Stahl, volume 2, Publisher: Verein Deutscher Eisenhüttenleute, 1985, Springer-Verlag Berlin Heidelberg New York Tokio, Verlag Stahleisen m.b.H. Düsseldorf, Chapter D 10.3.2).

The European patent specification EP 1 431 408 B1 has furthermore proposed a stainless austenitic CrNiMnCu steel with a low Ni content with the following composition (in % by weight): 0.03-0.064% C, 0.2-1.0% Si, 7.5-10.5% Mn, 14.0-16.0% Cr, 1.0-5.0% Ni, 0.04-0.25% N, 1.0-3.5% Cu, traces of molybdenum and iron and unavoidable impurities as the remainder. In order to obtain the cold-rollability, it is specified here for the δ ferrite content ("delta ferrite content"), that its content calculated by a formula disclosed in EP 1 431 408 B1 itself is less than 8.5%. The steel obtained in this manner exhibits comparable mechanical properties to the known steel 1.4301.

A stainless austenitic CrNiMnCuN steel belonging to the type of steels observed here is also known from EP 0 593 158 A1. This steel, apart from iron and unavoidable impurities, has (in % by weight)<0.15% C, <1% Si, 6.4-8.0% Mn, 16.5-17.5% Cr, 2.50-5.0% Ni, <0.2% N and 2.0-3.0% Cu. Good hot rollability, in particular the avoidance of edge cracks during hot rolling, has been achieved in this steel, at the same time as acceptable mechanical properties and corrosion-resistance. In order to reliably ensure this property combination, the Cr content of the steel is in each case adjusted here such that it certainly does not exceed 17.5% by weight.

A possibility for appropriately priced production of a steel strip or sheet consisting primarily of Mn-austenite is known from EP 1 319 091 B1, which has increased strength compared to the prior art. For this purpose, a steel is melted, which contains (in % by weight) at least the following alloy components: 15.00-24.00% Cr, 5.00-12.00% Mn, 0.10-0.60% N, 0.01-0.2% C, max. 3.00% Al and/or Si, max. 0.07% P, max. 0.05% S, max. 0.5% Nb, max. 0.5% V, max. 3.0% Ni, max. 5.0% Mo, max. 2.0% Cu as well as iron and unavoidable impurities as the remainder. A steel of this type is, in this case, cast into the casting nip formed between two rotating rollers of a twin-roller casting machine to form a thin strip with a thickness of max. 10 mm. In the meantime, the rollers or rolls are cooled so much that the thin strip in the casting nip is cooled at a cooling rate of at least 200 K/s. The known method in this manner uses the basically known technology of a strip casting system, in which it casts the steel in the casting nip formed between the rollers or rolls, for example of a two-roller casting apparatus ("double roller") and cools it so much that a shift occurs from a primary ferritic solidification in the direction of a primary austenitic solidification. This makes it possible to transfer the nitrogen dissolved in the melt into the steel, as the austenite has high solubility with respect to nitrogen. Owing to the intensive cooling taking place at a high cooling rate, it is ensured here that nitrogen gas bubbles possibly being produced in the solidifying melt remain small and the pressure directed against them is big. This prevents emission of the high nitrogen content in the course of the solidification.

Finally, an economically producible stainless steel is known from EP 1 352 982 B1, which is also not sensitive to the production of stress cracks during conventional cold forming. In this steel, instead of the conventionally aimed for, single-phase purely austenitic microstructure, a two-phase mixed microstructure is adjusted, in which by adding Si and/or Mo and partly by lowering the Ni content or by replacing Ni by Cu, the austenite (A) and ferrite (F) proportions are adjusted. The austenite is thus stabilised to such extent that martensite formation occurring during the forming no longer leads to stress cracks. In % by weight given, the chrome content of the steel known from EP 1 352 982 B1 is between 16 and 20%, the manganese content is between 6 and 12%, the nickel content is less than or equal 9.05% and the copper content is at less than or equal to 3%. Nitrogen is to be added at between 0.1 and 0.5%. The alloy is composed such that the t-factor (ratio of ferrite-forming elements to austenite-forming elements with respective prefactors) is within a corridor of more than 1.3 to less than 1.8. At the same time, the MD30 temperature of the alloy has to satisfy a specific condition.

SUMMARY OF TUE INVENTION

The solution according to the invention to the object mentioned above in relation to the flat steel product is given in claim 12, an advantageous configuration of this product being mentioned in claim 13.

A stainless CrMnNiCu steel with higher Mn and Cu content and a low Ni content as an economical alternative material to 1.4301 is made available by the invention and can be advantageously processed by strip casting to form a flat steel product.

The alloy components of the steel composed according to the invention are selected here such that its microstructure in the cold-rolled state, apart from austenite, has a δ ferrite content ("delta ferrite content") of 5-15% by volume. This δ ferrite content is measured here such that the steel according to the invention as a cold strip with good strength has a corrosion resistance approximating the steel 1.4301. The mechanical properties of a flat steel product cold-rolled from the steel according to the invention, such as yield strength and tensile strength, are shifted relative to the steel 1.4301 to higher values and the elongation at break to lower A80 values. The technological characteristics to assess the cold formability, such as the limiting draw ratio and the spherical cap height in the cupping test, are in the lower distribution range of the values determined for steel sheets produced from the steel 1.4301.

Because of its particular property combination, the steel according to the invention is consequently suitable as a replacement for the steel 1.4301 in the production of products coming within the "white goods" area and for use in other application areas, in which steel sheets are formed, in each case, with significant deep-drawing and stretch-drawing fractions to form the respective product.

DESCRIPTION OF THE INVENTION

The steel according to the invention for this purpose has (in % by weight):

C: 0.05-0.14%,
Si: 0.1-1.0%,
Mn: 4.0-12.0%,
Cr: >17.5-22.0%,
Ni: 1.0-4.0%,
Cu: 1.0-3.0%,
N: 0.03-0.2%,
P: max. 0.07%,
S: max. 0.01%,
Mo: max. 0.5%,
optionally one or more elements from the group "Ti, Nb, B, V, Al, Ca, As, Sn, Sb, Pb, Bi, H" with the following stipulation
Ti: max. 0.02%,
Nb: max. 0.1%,
B: max. 0.004%,
V: max. 0.1%,
Al: 0.001-0.03%,
Ca: 0.0005-0.003%,
As: 0.003-0.015%,
Sn: 0.003-0.01%,
Pb: max. 0.01%,
H: max. 0.0025%,
remainder Fe and unavoidable impurities.

Cr is primarily contained to improve the corrosion resistance in contents of more than 17.5% by weight to a maximum of 22.0% by weight in the steel according to the invention. The specification that in each case more than 17.5% by weight Cr is to be contained in the steel according to the invention, ensures here that a corrosion resistance comparable with the steel 1.4301 is achieved. This is achieved particularly reliably when the Cr content is at least 17.7% by weight, in particular at least 18.0% by weight. The results achieved by the invention occur, in particular, when the Cr content of the steel according to the invention is limited to 20% by weight.

C and N are strong austenite formers and moreover effectively increase the resistance against the formation of forming martensite during the processing of steels according to the invention. Therefore, the lower limit of the C content has been set at 0.05% by weight and the lower limit for the N content has been set at 0.03% by weight.

By maintaining an upper limit of 0.14% by weight for the C content, the danger of chromium carbide formation in a heat treatment, for example during welding and intercrystalline corrosion accompanying it, is avoided.

As an interstitial element, N leads to an increase in the yield strength and is therefore fixed at a maximum of 0.2% by weight. In order to ensure formability that is as good as possible, the N content is preferably limited to 0.12% by weight. The effect of nitrogen in a stainless steel according to the invention accordingly starts, in particular, when its N content is at least 0.06% by weight, in particular 0.06-0.10% by weight.

Si assists the formation of ferrite. The Si content of a steel according to the invention is therefore limited to a maximum of 1% by weight, in particular 0.5% by weight, it being possible to avoid the undesired effect of Si, in particular, in that the Si content of the steel according to the invention is limited to a maximum of 0.4% by weight.

Mo is not deliberately added to steel according to the invention, as it, on the one hand, assists the ferrite formation and, on the other hand, is expensive. The Mo content is therefore preferably as low as possible. In particular, the Mo content can be lowered according to the invention to such an extent that it is limited to ineffective quantities to be allocated to unavoidable impurities caused by production.

Ni is added to the steel according to the invention as an austenite former, a minimum content of 1% by weight being necessary to ensure the δ ferrite content ("delta ferrite content") in a steel according to the invention at a maximum of 25% in the hot strip, and good forming properties, so the aimed for delta ferrite content of the cold strip according to the invention, limited to a maximum of 15%, is reliably maintained. This effect is particularly reliably achieved if the Ni content is at least 1.5% by weight, in particular at least 2.0% by weight. By limiting the Ni content to at most 4% by weight, a clear reduction in the cost of alloying means is achieved in comparison to the steel 1.4301.

The reduction in the Ni content is possible due to adding the austenite formers Mn and Cu.

Copper has a similar austenite-stabilising effect to nickel. A too high copper content may, however, lead to the formation of copper-rich deposits with a low melting point, which in particular when casting the steel according to the invention in a strip casting system to form a cast strip or the hot rolling taking place subsequently inline, could cause cracks. Therefore, the invention provides an upper limit for copper of 3%. In order to ensure the effect of Cu in the steel according to the invention, a minimum Cu content of 1.5% by weight, in particular 2.0% by weight has proven to be favourable, contents of 2.1% by weight and more having proven successful in practical tests.

The austenite-forming effecting of Mn in a steel according to the invention occurs at Mn contents of at least 4% by weight. From an alloying means technological, economical point of view the Mn content is restricted to a maximum of 12% by weight, an optimised effect of the manganese being achieved in the steel according to the invention if the Mn content is 4.0-10.5% by weight, in particular 7.5-10.5% by weight.

The P and S contents are restricted to a maximum of 0.07% by weight for P and a maximum of 0.01% by weight for S in order to substantially exclude the negative influence of these alloying elements on the formability of the steel according to the invention.

To adjust certain properties in a steel according to the invention, contents of Ti, Nb, B, V, Al, Ca, As, Sn, Pb or H may optionally be present.

Ti contents of up to 0.02% by weight serve both in the production of the flat steel product according to the invention by means of continuous casting and also the so-called "strip casting route" to avoid cracks in the strip obtained.

Nb contents of up to 0.1% by weight have a favourable effect on the formability during a production both by means of continuous casting and also strip casting.

Boron may be added to steel according to the invention in contents of up to 0.004% by weight in the case of its processing by means of strip casting in order to counteract the danger of crack formation. If the steel is cast by continuous casting, the presence of B up to the mentioned upper limit contributes to the avoidance of surface cracks.

By adding Al in contents of 0.001-0.03% by weight, the degree of purity of the steel according to the invention can be improved. The presence of Ca in contents of 0.0005-0.003% by weight serves the same purpose.

The danger of crack formation can be minimised by contents of As of 0.003 to 0.015% by weight, Sn of 0.003-0.01% by weight, Pb of up to 0.01% by weight and Bi of up to 0.01% by weight during the processing of a steel according to the invention by strip casting. In the event of processing by continuous casting, these elements, within the content limits mentioned, help to reduce the danger of the occurrence of surface faults during hot rolling.

An optimal ratio with regard to the properties in particular aimed for in the cold-rolled state, of the austenite and ferrite-forming alloy constituents is produced if for the factor $$t = \frac{\%\ Cr + 2\%\ Mo + 1.5\%\ Si + 3\%\ Al - 5}{0.3\%\ Mn + \%\ Ni + 0.5\%\ Cu + 15(\%\ C + \%\ N) + 2}$$

t is less than or equal to 1.3, wherein % C designates the C content, % N the N content, % Si the Si content, % Al the Al content, % Mn the Mn content, % Cr the Cr content, % Ni the Ni content, % Mo the Mo content and % Cu the Cu content of the respective steel composition. This applies, in particular, when t is less than 1.3, the properties aimed for according to the invention being adjusted particularly reliably when t is at most 1.2.

According to the invention, a steel product cold-rolled from a steel composed according to the invention, in other words, for example, a cold-rolled steel strip or steel sheet, has an elongation A80 of at least 35%. In a cold-rolled flat steel product according to the invention composed in this manner, the limiting draw ratio during deep-drawing of a rotationally symmetrical cup is 2.00. "Limiting draw ratio" means here the largest draw ratio in the first draw formed from the diameter of the round blank, from which the cup is drawn, to the diameter of the die used to deep draw the cup, during which draw, with a certain holding down force, a cup can be deep-drawn without base cracks or folds. The round blank is, in this case, completely clamped at its outer edge between a drawing ring and a holding-down device. A die with a diameter of 100 mm then penetrates into the round blank and forms a spherical cap in a deep-drawing process. This process is continued until the sheet metal material tears. The crack-free spherical cap height achieved under these conditions, in a cold strip or sheet produced from steel according to the invention is regularly 58 mm. Accordingly, a flat steel product composed according to the invention has a property combination, which makes it suitable in an optimal manner for a forming, for example by deep-drawing or comparable operations.

The production of a cold-rolled flat steel product according to the invention in general comprises the working steps "melting, treating and after-treating the steel in the steel works", "producing cast strip by strip casting from the steel", "hot rolling the cast strip or the slab", "preparing (annealing and pickling/de-scaling) the hot strip for the cold-rolling", "cold rolling", "final annealing of the cold strip" and "final processing (temper rolling, stretch levelling, trimming) the cold strip".

Each of these working sections may in this case comprise optional working steps, which are in each case, for example, carried out depending on the system equipment available and the demands made by the user (customer).

To produce a flat steel product, according to the invention, a steel composed in the manner according to the invention is accordingly firstly melted. The melt composed in this manner is then cast in a twin-roller casting machine to form a cast strip. The solidification of the steel according to the invention primarily takes place here in a ferritic and then an austenitic manner here due to the high Cr content and low Ni content. The high cooling rates on which the strip casting is based favour significant δ ferrite fractions ("delta ferrite fractions") remaining in the hot strip.

The strip cast from the steel according to the invention is then hot-rolled inline following the strip casting in a continuous manufacturing sequence. A hot strip with a typical thickness of 1 to 4 mm is produced in this manner. On the way to the respective hot rolling stand, the cast strip may obviously pass through further workstations, such as a compensating or reheating furnace.

The processing of the steel according to the invention in a strip casting system has the advantage that the steel melt can be cast to form a strip with a minimised thickness, in particular restricted to a maximum of 4 mm, preferably a maximum of 3.5 mm and formings with degrees of forming of a maximum of 50% are then necessary to bring the cast strip to a final thickness. It is thus possible to produce, in a reliable process from steel according to the invention, despite its two-phase nature, a hot strip, which can then be supplied for conventional further processing into cold strip.

The procedure according to the invention is particularly advantageous when the hot rolling takes place in a single hot rolling pass. The total degree of forming $\epsilon$ achieved during the hot rolling should, in this case, be at most 50%, as an undesirably fine-grain microstructure is otherwise formed.

The hot rolling temperatures, at which the cast strip runs into the first rolling pass of the hot rolling, are preferably in the range of 1050-1200° C. here.

The invention will be described in more detail below with the aid of exemplary embodiments.

Table 1 gives the chemical compositions of three alloys E1-E4 coming under the invention.

To produce melts composed in accordance with these alloys E1-E4, alloyed and unalloyed scrap metal and ferro alloys were melted together in the steel works in an electric arc furnace.

Accordingly, the melt thus obtained from the electric arc furnace was further treated in an AOD converter (AOD=Argon Oxygen Decarburisation). The main aim of this treatment was to reduce the carbon content to a target value by blowing in an oxygen-argon mixture.

After the AOD treatment, the melt was cast into a ladle. The high quality requirements of the properties of the molten steels then made an after-treatment necessary. This took place by secondary metallurgy, the ladle or vacuum treatment of liquid crude steel. This working step, apart from homogenisation of the melt and the maintaining of narrow temperature limits or exact temperatures, primarily pursued the aim of adjusting low contents of the elements carbon, nitrogen, hydrogen, phosphorus and some trace elements in the steel.

The correspondingly treated melt was then hot rolled in a conventional twin-roller to form a cast strip with a thickness of 2.5-3.5 mm and then integrated directly in a pass to form a hot strip with a thickness of 1.5-2.5 mm. The hot rolling final temperature was 1100° C. here, hot rolling final temperatures of 1050-1200° C. basically being possible for the hot rolling of hot strips made of steels according to the invention, at forming degrees of 25-50%. Owing to the direct sequence of strip casting and hot rolling under said conditions, the danger of cracks and surface faults being produced can be avoided, said danger existing in a conventional processing of the steel alloys according to the invention which takes place over a multi-step hot rolling process, due to the two-phase nature of the hot strips produced therefrom.

For a comparison, two samples 4301.70, 4301.60 coming under the standardised alloy of the steel 1.4301 were melted, from which the sample 4301.70 was processed in the twin-roller with subsequent hot rolling in the manner described above for the samples E1-E4 to form hot strip with a thickness of 1.9-2.4 mm, while the sample 4301.60 was continuously cast in a conventional manner into slabs and processed in multi-stages to hot strip 2.8-3.6 mm thick.

The hot strips produced in the manner described above were then prepared for cold rolling. For this purpose, they were subjected to a hot treatment in the form of annealing at a temperature typically in the range of 1000-1180° C. during the processing of hot strips according to the invention. It was 1050° C. in each case in the exemplary embodiments described here.

The hot strips were then subjected to de-scaling in a known manner in order to free the hot strip surface from the oxide layer adhering thereto. A de-scaling of this type generally comprises a mechanical pre-de-scaling carried out, for example, with the aid of a conventional scale breaker, and pickling, in which the scale is substantially completely removed from the metallic surface of the hot strip using a liquid pickling medium.

The so-called "white" hot strip annealed and pickled clean in this manner is wound into coils and supplied to the cold-rolling stand.

The cold rolling of the hot strips to the required final thickness of 0.8 mm was carried out without prior heating on a 20-roll cold-rolling stand. This cold-rolling stand type is in a position to apply the high forming forces necessary for processing high-grade steels and simultaneously ensures that the tolerances required by the customers are maintained with regard to the surface quality and thickness. The degrees of forming achieved during the cold rolling in the processing according to the invention are typically in the range of 40-80%.

The cold strip that has solidified during the cold rolling was annealed to restore its forming properties required for further processing recrystallising at an annealing temperature of 1140° C. Annealing temperatures suitable for the recrystallising annealing of flat steel products according to the invention are in the range of 1050-1180° C.

In the present exemplary embodiments, the recrystallising annealing was carried out on a conventional annealing and pickling line, in which the cold strip was firstly annealed in an open atmosphere and then again freed in the pickling section from the scale produced in the process. Alternatively, it is also possible, when there are particularly high requirements of the surface composition, to carry out the annealing under a protective gas atmosphere of a bright annealing line. The mechanically glossy surface of the cold strip is retained here and its gloss is reinforced by the concluding heat treatment in a protective gas atmosphere.

For the final adjustment of the mechanical properties desired by the customer, the flatness, the surface fine structure and the gloss, the heat-treated cold strips were finally subjected to temper rolling. Twin-roller or four-roller temper rolling stands with polished working rollers are generally used for this purpose.

The δ ferrite contents of the hot strips ("HS") produced from the steels E1-E4, 4301.70 and 4301.60 and their respective mechanical properties, proof stress Rp, tensile strength Rm and elongation A80 are listed in Table 2. Likewise, the delta ferrite content, δ-ferrite, the granulation of their microstructure evaluated to ASTM and the proof strength Rp, tensile strength Rm and elongation A80 are given in Table 2 for the 0.8 mm thick cold strips produced from the steels E1-E4, 4301.70 and 4301.60 in the manner explained here.

With the cold strips generally obtained from the samples according to the invention, the values of the proof stress and tensile strength are above the values of the cold strips produced from the comparative samples 4301.70 and 4301.60.

The elongation values A80 for the cold strips produced from samples E1-E4 are between 44.4% and 48.5% transverse to the rolling direction, while elongation values A80 of 53% and 57.6% could be determined for the comparative samples 4301.70 and 4301.60.

The δ ferrite fraction ("delta ferrite fraction") of the steel according to the invention in the cold strip has contents between 8.5% and 13% and thus clearly above the values determined for the two comparison samples. Clear δ ferrite fractions present in the samples according to the invention explain the low elongation values. Moreover, in particular the cold strip produced from the samples E1-E4 with ASTM values of up to 10 is very fine-grained, which is a possible cause for the high strength level. In addition, elements such as carbon and nitrogen or manganese as interstitially or substitutionally released atoms (in the form of a mixed crystal) increase the strength properties.

The technological characteristics, which are suitable for evaluating the formability, of the cold strips produced from the samples E1 and E4 as well as 4301.60 are listed in Table 3.

The spherical cap height, as a characteristic for the stretch-drawing capacity in the cold strips produced from the samples E1 and E4, is in the range of or slightly below the values which could be determined from the two comparative samples.

The limiting draw ratio in the cold strips produced from the samples E1 and E4 is also in the range of the limiting draw ratio of the sample 4301.60. The cold strips according to the invention therefore have a deep-drawing capacity which is equally as good as the samples produced from the conventional steel 1.4301.

Accordingly, components with a high deep-drawing fraction and a large draw depth can be produced from steel according to the invention. Cold-rolled flat steel products produced in the manner according to the invention exhibit a lower earing during their forming than cold strips which were produced in a conventional manner by continuous casting from the steel 1.4301. This shows a more isotropic flow behaviour of the steel according to the invention caused by a smaller rolling texture in the cold strip. Such behaviour proves to be particularly advantageous in many deep-drawing processes. The r-values in the transverse direction of cold-rolling products produced according to the invention are in the range of the conventionally produced material.

The cold strip obtained after temper rolling can be subjected, if necessary, to a stretch levelling and trimming. These manufacturing steps are generally carried out separately. Grinding lines can then, if necessary, also provide the strips with different grinding patterns on the strip surface. For the highest requirements of the flatness of a high-grade steel sheet, temper-rolled or else non-temper-rolled cold strips are treated in strip stretching systems. Residual stresses possibly present, which can lead to a lack of flatness of a strip, are compensated in this manner.

A steel is therefore made available by the invention, the corrosion resistance of which is comparable with that of the steel 1.4301. The δ ferrite content ("delta ferrite content") in hot and cold strip produced from steel according to the invention is thus adjusted by means of the chemical composition and the rapid solidification possible in the course of the strip casting selected as the processing method with hot rolling then completed inline in such a way that elongation at break values significantly above 35%, in particular above 40%, are achieved and the technological forming properties are in the distribution range of the material 1.4301.

TABLE 1

| Sample | C | Si | Mn | Cr | Mo | Ni | N | Cu |
|---|---|---|---|---|---|---|---|---|
| E1 | 0.057 | 0.15 | 7.57 | 18.01 | 0.1 | 3.06 | 0.11 | 2.22 |
| E2 | 0.06 | 0.11 | 7.6 | 18.0 | 0.1 | 3.08 | 0.09 | 2.31 |
| E3 | 0.053 | 0.11 | 7.74 | 17.92 | 0.14 | 3.9 | 0.11 | 1.61 |
| E4 | 0.09 | 0.09 | 8 | 18.24 | 0.09 | 2.15 | 0.1 | 2.32 |
| 4301.70 | 0.04 | 0.2 | 1.24 | 18.14 | 0.25 | 8.52 | 0.049 | 0.26 |
| 4301.60 | 0.04 | 0.39 | 1.24 | 18.15 | 0.25 | 8.54 | 0.049 | 0.26 |

Details in % by weight

TABLE 2b

| | Hot strip | | | | Cold strip | | | | | |
|---|---|---|---|---|---|---|---|---|---|---|
| Sample | δ-ferrite [%] | Rp [Mpa] | Rm [MPa] | Ag [%] | δ-ferrite [%] | Rp [Mpa] | Rm [MPa] | Rp/Rm [%] | A80 [%] | Granularity according to ASTM |
| E1 | 14 | — | — | — | 13 | 332 | 646 | 0.51 | 47.4 | 10 |
| E2 | 14 | 336 | 651 | 43.2 | 11 | 341 | 637 | 0.54 | 44.4 | 10 |
| E3 | 12 | 334 | 657 | 46 | 8.5 | 357 | 675 | 0.53 | 48.5 | 10 |
| E4 | 13.9 | 360 | 685 | 41.6 | 11.7 | 390 | 705 | 0.55 | 41.2 | 10 |
| 4301.70 | 2.0-8.0 | 325 | 633 | 50 | 1-2 | 304 | 645 | 0.47 | 53 | 9 |
| 4301.60 | 1.0-2.0 | — | — | — | 0 | 285 | 624 | 0.46 | 57.6 | 8.5 |

"—" = not determined

TABLE 3

| Sample | Thickness [mm] | Spherical cap height [mm] | Limiting draw ratio | Earing [mm] |
|---|---|---|---|---|
| E1 | 0.8 | 61.7-63.1 | 2.00 | 2.14 |
| E4 | 0.8 | 63-65 | 2.06 | 2.44 |
| 4301.60 | 0.8 | 63-67 | 2.00-2.06 | 3.7-6.5 |

The invention claimed is:

1. A stainless steel having a microstructure in the cold-rolled state of 8.5-13% by volume δ-ferrite and austenite as the remainder, and comprising (in % by weight):

C: 0.05-0.14%;
Si: 0.1-1.0%;
Mn: 7.5-10.5%;
Cr: >17.5-22.0%;
Ni: 1.0-4.0%;
Cu: 1.0-3.0%;
N: 0.03-0.2%;
P: max. 0.07%;
S: max. 0.01%;
Mo: max. 0.5%;
optionally one or more elements from the group consisting of Ti, Nb, B, V, Al, Ca, As, Sn, Sb, Pb, Bi, and H wherein
Ti: max. 0.02%;
Nb: max. 0.1%;
B: max. 0.004%;
V: max. 0.1%;
Al: 0.001-0.03%;
Ca: 0.0005-0.003%;
As: 0.003-0.015%;
Sn: 0.003-0.01%;
Pb: max. 0.01%;
Bi: max. 0.01%;
H: max. 0.0025%; and
remainder Fe and unavoidable impurities.

2. The stainless steel according to claim 1, wherein for $$t = \frac{\%\ Cr + 2\%\ Mo + 1.5\%\ Si + 3\%\ Al - 5}{0.3\%\ Mn + \%\ Ni + 0.5\%\ Cu + 15(\%\ C + \%\ N) + 2}$$

$t \leq 1.3$, wherein % C designates the C content, % N the N content, % Si the Si content, % Al the Al content, % Mn the Mn content, % Cr the Cr content, % Ni the Ni content, % Mo the Mo content and % Cu the Cu content of the respective steel composition.

3. The stainless steel according to claim 1, wherein the Si content is 0.1-0.4% by weight.

4. The stainless steel according to claim 1, wherein the Cr content is max. 20.0% by weight.

5. The stainless steel according to claim 1, wherein the Cr content is at least 17.7% by weight.

6. The stainless steel according to claim 1, wherein the Ni content is at least 1.5% by weight.

7. The stainless steel according to claim 1, wherein the steel contains at least 1.5% by weight Cu.

8. The stainless steel according to claim 7, wherein the Cu content is at least 2.0% by weight.

9. The stainless steel according to claim 1, wherein the N content is 0.03-0.10% by weight.

10. A cold-rolled flat steel product comprising the steel according to claim 1.

11. The cold-rolled flat steel product according to claim 10, wherein elongation A80 is at least 35%.

12. The cold-rolled flat steel product according to claim 10, wherein the limiting draw ratio when deep-drawing a rationally symmetrical cup is 2.00.

13. A method for producing a flat steel product, comprising steel strip or steel sheet, comprising the following working steps:

melting a stainless steel composed according to claim 1, casting the molten steel in a twin-roller to form a cast strip;

hot rolling the cast strip inline following the casting of the cast strip to form a hot strip.

14. The method according to claim 13, wherein the hot rolling takes place in a single hot rolling pass.

15. The method according to claim 13, wherein the total degree of forming $\epsilon$ achieved during the hot rolling is at most 50%.

16. The method according to claim 13, wherein the cast strip runs into the first rolling pass at a hot rolling starting temperature in the range of 1050-1200° C.

17. The method according to claim 13, wherein the thickness of the cast strip is at most 4 mm.

18. The method according to claim 13, further comprising cold-rolling the hot strip to form a cold strip.

19. The stainless steel according to claim 1, wherein the Cr content is at least 18.0% by weight.

* * * * *

UNITED STATES PATENT AND TRADEMARK OFFICE

CERTIFICATE OF CORRECTION

PATENT NO. : 8,608,873 B2
APPLICATION NO. : 13/061842
DATED : December 17, 2013
INVENTOR(S) : Abratis et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 133 days.

Signed and Sealed this
Twenty-second Day of September, 2015

Michelle K. Lee

Michelle K. Lee
*Director of the United States Patent and Trademark Office*